US010794058B2

(12) United States Patent
Raab

(10) Patent No.: US 10,794,058 B2
(45) Date of Patent: Oct. 6, 2020

(54) STRUCTURAL PANEL

(71) Applicant: The Pro Design Group, Gardena, CA (US)

(72) Inventor: Christopher A. Raab, Sunset Beach, CA (US)

(73) Assignee: The Pro Design Group, Gardena, CA (US)

( * ) Notice: Subject to any disclaimer, the term of this patent is extended or adjusted under 35 U.S.C. 154(b) by 67 days.

(21) Appl. No.: 15/649,336

(22) Filed: Jul. 13, 2017

(65) Prior Publication Data

US 2019/0017270 A1 Jan. 17, 2019

(51) Int. Cl.

| | |
|---|---|
| ***B32B 3/30*** | (2006.01) |
| ***B32B 7/12*** | (2006.01) |
| ***B32B 15/18*** | (2006.01) |
| ***E04C 2/292*** | (2006.01) |
| ***E04C 2/296*** | (2006.01) |
| ***E04C 2/34*** | (2006.01) |
| ***E04F 13/08*** | (2006.01) |
| ***E04F 13/00*** | (2006.01) |
| ***E04F 13/18*** | (2006.01) |

(52) U.S. Cl.

CPC ..... *E04C 2/296* (2013.01); *E04C 2/292* (2013.01); *E04C 2/3405* (2013.01); *E04F 13/007* (2013.01); *E04F 13/0866* (2013.01); *E04F 13/18* (2013.01); *E04C 2002/3438* (2013.01); *E04F 13/0875* (2013.01); *E04F 2290/044* (2013.01); *E04F 2290/046* (2013.01)

(58) Field of Classification Search

CPC .. B32B 3/30; B32B 7/12; B32B 15/18; B32B 15/20; B32B 15/082; B32B 2250/03; B32B 2307/306; E04C 2/34; E04C 2002/3433; E04C 2002/3411; E04C 2002/3438; E04C 2/292; E04C 2/296; E04C 2/3405; E04F 13/0866; E04F 13/18; E04F 13/0875; E04F 2290/046

See application file for complete search history.

(56) References Cited

U.S. PATENT DOCUMENTS

| | | | | |
|---|---|---|---|---|
| 3,876,492 A * | 4/1975 | Schott | E04C 2/3405 | 52/789.1 |
| 5,823,175 A * | 10/1998 | Sweitzer | F24B 9/00 | 126/34 |
| 5,868,081 A | 2/1999 | Raab | | |
| 6,460,297 B1 * | 10/2002 | Bonds | E04C 2/384 | 52/234 |

(Continued)

OTHER PUBLICATIONS

The Pro Design Group "Quality Products Through Design", Marketing Flyer distributed on Jul. 14, 2016, 1 page.

*Primary Examiner* — Joanna Pleszcynska

(74) *Attorney, Agent, or Firm* — Matthew J. Spark; Stefan J. Kirchanski; Zuber Lawler & Del Duca LLP

(57) ABSTRACT

A structural panel includes a core and first and second facing sheets. The core has bonding surfaces on first and second, opposite sides thereof. The first facing sheet is a non-thermoplastic, fire retardant facing sheet having an inner surface bonded to the bonding surface on the first side. The second facing sheet is bonded to the bonding surface on the second side. The first facing sheet is fire retardant or non-flammable and the core is at least fire retardant. The structural panel finds particular utility as a building-cladding panel.

19 Claims, 3 Drawing Sheets

(56) References Cited

U.S. PATENT DOCUMENTS

| | | | | |
|---|---|---|---|---|
| 7,748,181 | B1 * | 7/2010 | Guinn | E04F 13/0878 52/235 |
| 2005/0025929 | A1 * | 2/2005 | Smith | B32B 3/12 428/73 |
| 2007/0020441 | A1 * | 1/2007 | Kim | B21D 47/00 428/180 |
| 2009/0239429 | A1 * | 9/2009 | Kipp | C04B 28/26 442/1 |
| 2012/0231214 | A1 * | 9/2012 | Straza | B32B 3/28 428/131 |
| 2014/0130657 | A1 * | 5/2014 | Pilpel | F41H 5/0485 89/36.02 |

* cited by examiner

STRUCTURAL PANEL

BACKGROUND

Structural panels are used in a wide variety of situations. They can be used in creating support platforms for furniture, such as shown in U.S. Pat. No. 5,868,081. They can also be used in the manufacture of crating and in architectural situations to create facing panels for walls or other building structures. For example, structural panels in the form of plywood sheathing can be used to create timber shear walls. Structural panels can also be used for knock-down crates, garden sheds, interior wall panels, music instrument cases, box trailers, hunting cases, van conversions, cabinetry, outdoor signs, podiums, subfloors, roof and wall structural sheathing product, barn walls, truck panels, etc.

SUMMARY

A structural panel includes a core and first and second facing sheets. The core has bonding surfaces on first and second, opposite sides thereof. The first facing sheet is a non-thermoplastic, fire retardant facing sheet having an inner surface bonded to the bonding surface on the first side. The second facing sheet is bonded to the bonding surface on the second side. The first facing sheet is fire retardant or non-flammable and the core is at least fire retardant.

In some examples the structural panel can include one or more the following. The first facing sheet and the core can be mold and mildew resistant. The core can include protrusions and cavities on said first and second sides, the protrusions defining at least some of the bonding surfaces, with at least some of the bonding surfaces being spaced apart bonding surfaces; at least some of the protrusions and cavities can be separated by saddles, the saddles having a concave surface portions extending between the protrusions and convex surface portions extending between the cavities. The facing sheets can be made from one or more of: ferrous or nonferrous metal, including galvanized steel, powder coated steel, or aluminum; fiberglass reinforced plastic, thermoset plastic, and ballistic sheet material. The second facing sheet can be a non-thermoplastic, fire retardant second facing sheet.

A building-cladding panel includes a core, a thermoset adhesive, and non-thermoplastic first and second facing sheets. The core is a fire retardant, mold and mildew resistant core having bonding surfaces on first and second, opposite sides thereof. The core includes protrusions and cavities on said first and second sides, the protrusions defining at least a majority of the bonding surfaces, at least a majority of the bonding surfaces being spaced apart bonding surfaces. The first and second facing sheets each have an inner surface bonded to the bonding surface on the first and second sides with the thermoset adhesive. The first facing sheet includes at least one of: ferrous or nonferrous metal, including galvanized steel, powder coated steel, or aluminum; fiberglass reinforced plastic, thermoset plastic, or ballistic sheet material. The first facing sheet is fire retardant or non-flammable. The core is at least fire retardant.

Other aspects and advantages of the present technology can be seen on review of the drawings, the detailed description and the claims, which follow.

DETAILED DESCRIPTION

A detailed description of embodiments of the present technology is provided with reference to FIGS. 1-4.

Figure 1:
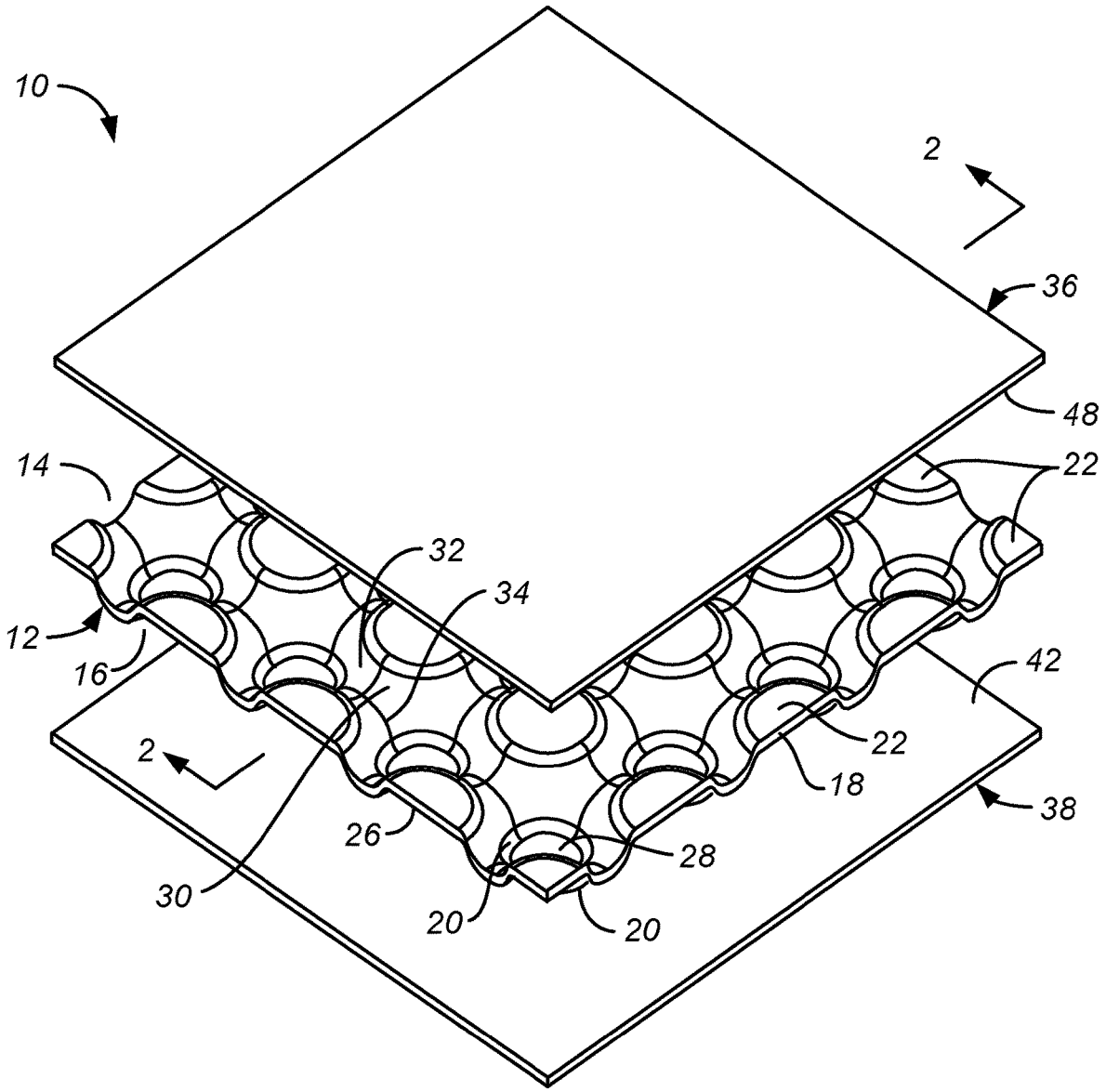
FIG. 1 is a an exploded isometric view of an example of a structural panel including first and second facing sheets to be bonded to the opposite sides of a core.
Figure 2:
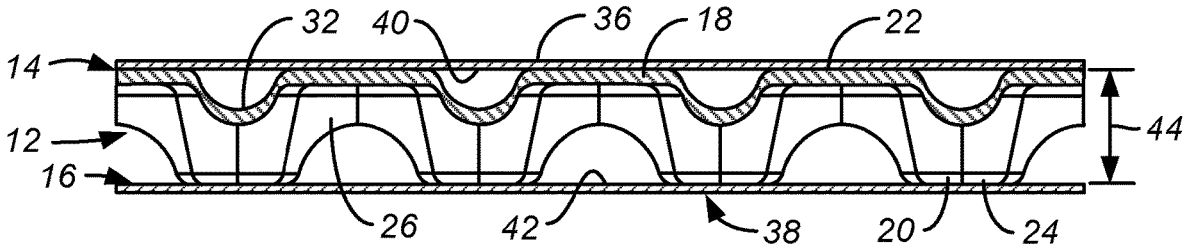
FIG. 2 is a cross-sectional view of the structural panel of FIG. 1 in an assembled form taken along the cutting plane line 2-2 of FIG. 1.
Figure 4:
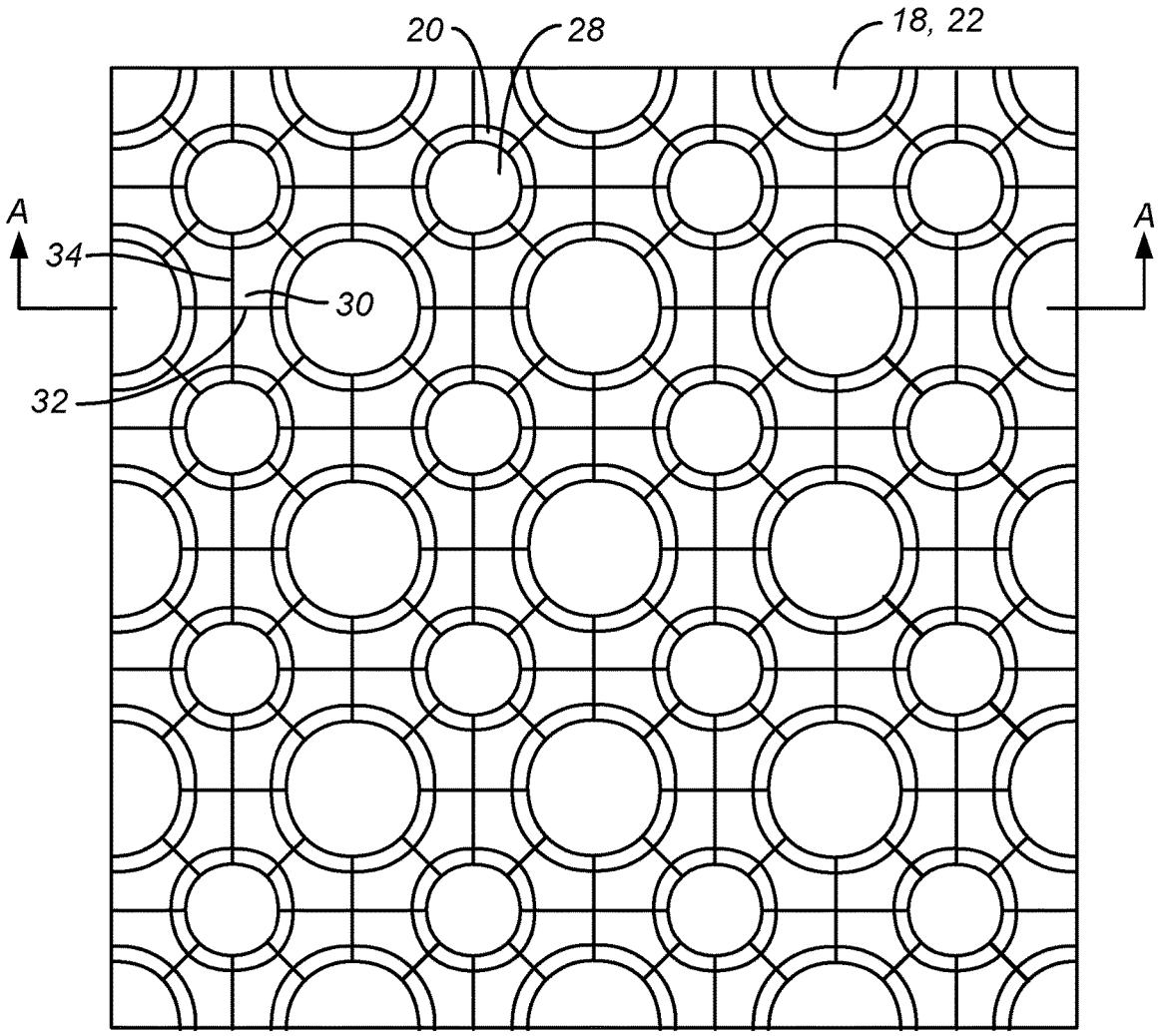
FIG. 4 is a top plan view of the core of FIG. 3 with cutting plane line A-A corresponding to the cutting plane line 2-2 of FIG. 1.
Figure 3:
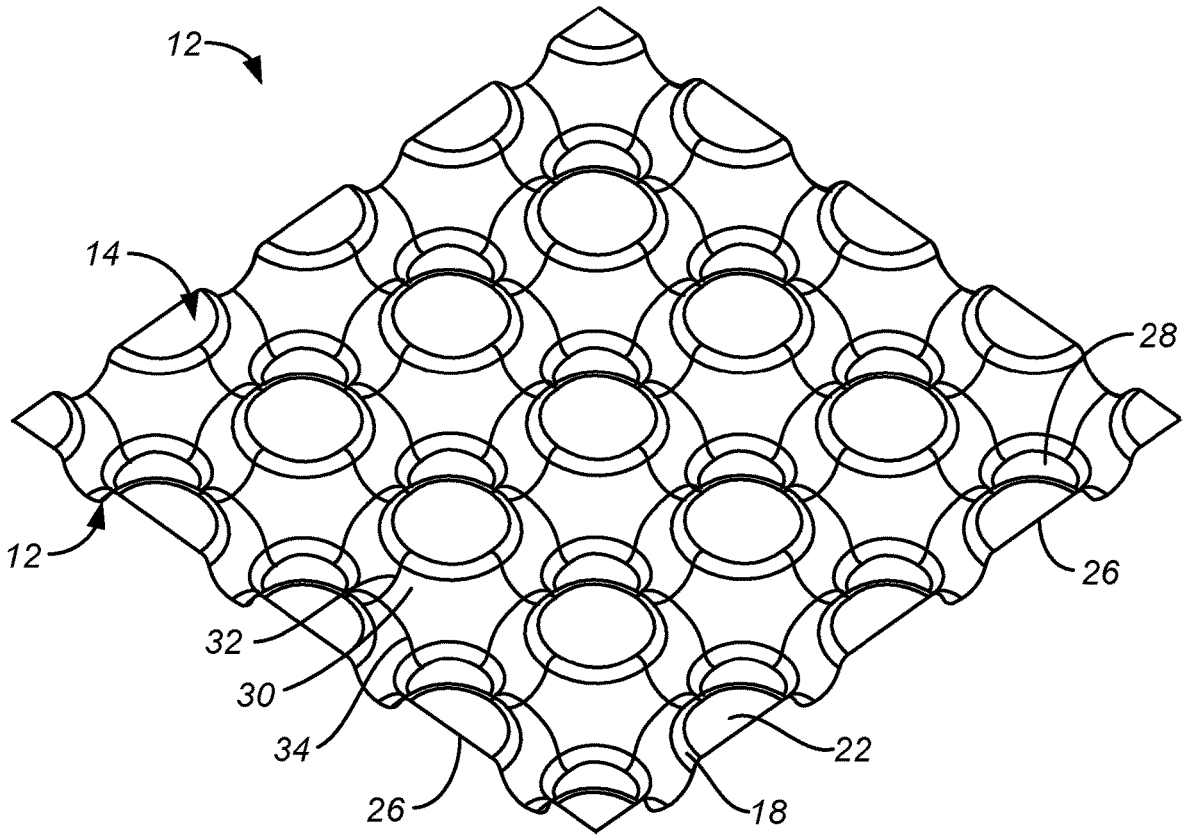
FIG. 3 is a somewhat simplified isometric view of the core of FIG. 1.

FIG. 1 is an exploded isometric view of a structural panel 10 including a core 12 having first and second sides 14, 16. Referring also to FIG. 2, core 12 includes first and second protrusions 18, 20 extending in opposite directions towards the first and second sides 14, 16. First protrusions 18 have first bonding surfaces 22 at first side 14 while second protrusions 20 have second bonding surfaces 24 at second side 16. First protrusions 18 created first cavities 26 extending towards second side 16 while second protrusions 20 create second cavities 28 extending towards first side 14. In this example the first bonding 22 surfaces created by first protrusions 18 create larger surface areas than the second bonding surface 24 created by second protrusions 20. In some examples the bonding surfaces created by each protrusion can be equal. Also, the bonding surfaces created by the protrusions on either side can have different surface areas. The bonding surfaces can be evenly spaced as disclosed, or not.

In this example first and second protrusions 18, 20 and first and second cavities 26, 28 are separated by saddles 30. Saddles 30 on first side 14 have concave portions 32 extending between adjacent first protrusions 18 and convex portions 34 extending between adjacent and second cavities 28. The saddles on second side 16 have similar shapes.

The material from which core 12 is made can be ABS (acrylonitrile-butadiene-styrene) thermoplastic polymer. A rigid, UL listed fire-rated Acrylic ABS sheet designed to retard microbe development using antimicrobial technology to inhibit the growth of mold and mildew commonly found in architectural environments which passes ASTM E84 Steiner tunnel test can be used; these sheets have been treated to be fire-retardant so as to reduce flammability of the panel. One example of such a fire-rated antimicrobial material is Royalite R52 AM PVC/acrylic from PolyOne Corporation of Clayton Mo. Core 12 can also include insulating material, such as EPS (expanded polystyrene) foam within the open regions to improve the thermal insulation R-value of the structural panel 10.

Structural panel 10 also includes first and second facing sheets 36, 38 bonded to bonding surfaces 22, 24 on the first and second sides 14, 16 of core 12. In some examples prior to bonding, both sides of core 12 and the inner surfaces of facing sheets 36, 38 are sanded to help achieve a maximum bond. The sanded core and facing sheets can be subjected to Corona treatment, a high-frequency discharge to increase the adhesion of the facing sheets to the core. Adhesive layers 40, 42 are applied to the inner surfaces of first and second facing sheets 36, 38. This is followed by placing the adhesive sides of the facing sheets against the bonding surfaces of the core to create a pre-cured structural panel. The pre-cured structural panel is then placed in a press, often heated, typically for hours or days, to complete the bonding process. Although not presently preferred, in other examples the adhesive can be applied directly to the first and second bonding surfaces 22, 24 or to both the facing sheets and the bonding surfaces. While a range of adhesives can be used, a moisture curing polyurethane adhesive has been found to be very effective in providing a strong bond suitable for use when structural panel 10 is to be used as interior or exterior wall panels. One example is Vibra-Tite® 801LV Polyurethane adhesive from ND Industries, Inc. of Clawson, Mich.

Core 12 and facing sheets 36, 38 can be treated to inhibit the growth of mold and mildew commonly found in architectural environments. Pre-treated ABS sheets which have already been treated to be both fire-retardant and antimicrobial can be obtained from a commercial source and used for core 12. These materials are preferably manufactured in plants that are ISO 9001-2000 certified and materials are manufactured under good manufacturing practice (GMP) guidelines. The specific materials from which core 12 and facing sheets 36, 38 are made can affect the choice of the treatment.

Various non-thermoplastic materials can be used for facing sheets 36, 38; examples include: ferrous and nonferrous metal, including galvanized steel, powder coated steel, or aluminum; fiberglass reinforced plastic, thermoset plastic, and ballistic sheet material. Regarding ballistic sheet material, which can be referred to as fiber reinforced thermoplastic ballistic material, it can be post-formed and co-molded for strategic reinforcement to increase design flexibility, improve specific strength and lower component weight for high strain-to-failure ballistic resistance; ballistic sheet material is commercially available from, for example, PolyOne—Polystrand of Englewood, Colo. Ballistic sheet materials can be made using DuPont's Kevlar® aramid fiber. In one example fire-rated antimicrobial facing sheets 36, 38 are manufactured from recycled PVC/acrylic resin and are available from PolyOne Corporation of Clayton Mo. as Royalite R552 Flame Rated Sheet. In another example facing sheets 36, 38 are made from fiberglass reinforced plastic by the Kal-Lite Division of Kalwall Corporation of Bow, N.H. Facing sheets 36, 38 can be made from one or more materials. Facing sheet 36 can be made from the same or different materials as facing sheet 38. Facing sheets 36, 38 are preferably made from fire retardant material or a non-flammable material, also referred to as a noncombustible material, As used in this application, a fire retardant material is a material which meets the ASTM E84 test standard, and a non-flammable material is a material which meets the ASTM E-136 test standard.

A structural panel for use as a building-cladding panel on interior or exterior walls can be made to provide significant structural strength while being relatively thin, such as having: a core thickness 42 of between about 0.187 inch and about 0.750 inch; a facing thickness from about 0.020 inch and about 0.125 inch; resulting in a total panel thickness from about 0.250 inch to about 1 inch. Such a building-cladding panel can have a fire retardant core and fire retardant or non-flammable facing sheets to enhance the fire resistance of the building. Structural panel can be printed with artwork or logos. When used as a weather resistive barrier, if enclosed it will provide some thermal insulation and will increase the R-value.

While the present technology is disclosed by reference to the preferred embodiments and examples detailed above, it is to be understood that these examples are intended in an illustrative rather than in a limiting sense. It is contemplated that modifications and combinations will readily occur to those skilled in the art, which modifications and combinations will be within the spirit of the technology and the scope of the following claims.

What is claimed is:

1. A structural panel comprising:

a core having bonding surfaces on first and second, opposite sides thereof;

a non-thermoplastic first facing sheet having an inner surface bonded to the bonding surface on the first side;

a second facing sheet bonded to the bonding surface on the second side;

the first facing sheet being fire retardant or non-flammable; and the core being at least fire retardant, and formed from a single sheet of thermoplastic polymer material.

2. The structural panel according to claim 1, wherein the first facing sheet and the core are mold and mildew resistant.

3. The structural panel according to claim 1, wherein the core comprises protrusions and cavities on said first and second sides, said protrusions defining at least some of said bonding surfaces, at least some of said bonding surfaces being spaced apart bonding surfaces.

4. The structural panel according to claim 3, wherein at least some of the protrusions and cavities are separated by saddles, the saddles having a concave surface portions extending between said protrusions and convex surface portions extending between said cavities.

5. The structural panel according to claim 4, wherein:

the core has a thickness measured between said first and second sides; and the saddles comprise central portions located at positions centered between the first and second sides.

6. The structural panel according to claim 3, wherein at least some of the protrusions on the first and second sides correspond to said cavities on the second and first sides, respectively.

7. The structural panel according to claim 1, wherein the facing sheets are made from one or more of: ferrous or nonferrous metal; fiberglass reinforced plastic; thermoset plastic; and ballistic sheet material.

8. The structural panel according to claim 1, wherein the first facing sheet comprises a fireproof facing sheet.

9. The structural panel according to claim 1, wherein the first and second facing sheets are each bonded to the core by a layer of adhesive at least substantially covering the respective inner surfaces of the first and second facing sheets.

10. The structural panel according to claim 1, wherein the second facing sheet is a non-thermoplastic, fire retardant second facing sheet.

11. A building-cladding panel comprising:

a fire retardant, mold and mildew resistant core having bonding surfaces on first and second, opposite sides thereof;

the core comprising protrusions and cavities on said first and second sides, said protrusions defining at least a majority of said bonding surfaces, at least a majority of said bonding surfaces being spaced apart bonding surfaces;

a thermoset adhesive;

non-thermoplastic first and second facing sheets each having an inner surface, the inner surfaces of the first and second facing sheets bonded to the bonding surface on said first and second sides with the thermoset adhesive;

the first facing sheet comprising at least one of: ferrous or nonferrous metal; fiberglass reinforced plastic; thermoset plastic; and ballistic sheet material;

the first facing sheet being fire retardant or non-flammable; and the core being formed from a single sheet of thermoplastic polymer material.

12. The building-cladding panel according to claim 11, wherein the first and second facing sheets are mold and mildew resistant.

13. The building-cladding panel according to claim 11, wherein at least a majority of the protrusions and cavities are separated by saddles, the saddles having a concave surface portions extending between said protrusions and convex surface portions extending between said cavities.

14. The building-cladding panel according to claim 13, wherein:

the core has a thickness measured between said first and second sides; and the saddles comprise central portions located at positions centered between the first and second sides.

15. The building-cladding panel according to claim 14, wherein;

the thickness of the core is between about 0.187 inch and about 0.750 inch; and the building-cladding panel has a thickness from about 0.250 inch to about 1 inch.

16. The building-cladding panel according to claim 11, wherein at least some of the protrusions on the first and second sides correspond to said cavities on the second and first sides, respectively.

17. The building-cladding panel according to claim 11, wherein the thermoset adhesive comprises a layer of adhesive at least substantially covering the inner surface of the first facing sheet.

18. The building-cladding panel according to claim 11, wherein the thermoset adhesive comprises a polyurethane adhesive.

19. The building-cladding panel according to claim 11, wherein the first facing sheet comprises a fireproof facing sheet.

* * * * *